United States Patent [19]

Shinkawa

[11] Patent Number: 4,660,049

[45] Date of Patent: Apr. 21, 1987

[54] EXTENSIBLE ROD ANTENNA FOR VEHICLES

[75] Inventor: Masaki Shinkawa, Yamato, Japan

[73] Assignee: Harada Kogyo Kabushiki Kaisha, Tokyo, Japan

[21] Appl. No.: 723,854

[22] Filed: Apr. 16, 1985

[30] Foreign Application Priority Data

Apr. 20, 1984 [JP] Japan ..... 59-58075[U]

[51] Int. Cl.[4] ..... H01Q 1/10; H01Q 1/32

[52] U.S. Cl. ..... 343/715; 343/901

[58] Field of Search ..... 343/715, 901, 903

[56] References Cited

U.S. PATENT DOCUMENTS 4,542,383 9/1985 Cusey et al. ..... 343/903

*Primary Examiner*—Eli Lieberman

*Attorney, Agent, or Firm*—Koda and Androlia

[57] ABSTRACT

An extensible rod antenna system for vehicles including an extensible rod antenna element formed of conductive rods, an upper fitting member and a lower cylindrical fitting member clamping and holding the rod antenna to a fitting hole located on the vehicle wall, a drainage outlet provided on the side wall of the lower fitting member, and a drainage pipe connected to the drainage outlet which discharges outside of the vehicle. This extensible rod antenna system is improved in that it drains water leaking through the space between the extensible rod antenna element and the upper portion fitting member.

1 Claim, 6 Drawing Figures

EXTENSIBLE ROD ANTENNA FOR VEHICLES

BACKGROUND OF THE INVENTION

1. Field of the Invention

The present invention relates to a rod antenna for vehicles, such as automobiles, and more particularly to a drainage system for an extensible rod antenna system for vehicles.

2. Prior Art

Existing extensible rod antenna systems include a top portion 2 attached to the end of the smallest diameter rod 1, which serves as a decorative ball or as a pick-up knob for extending the antenna. A rod insulator 4 is fitted into the inner circumferential wall of the upper fitting member 3.

As shown in FIG. 1, with this structure rain water, etc. may leak into the rod storing housing 5 through the space between the top portion 2 and the rod insulator 4 when the antenna is retracted. Rain water, etc. can also leak into the housing 5 through the space between the smallest diameter rod 1 and the rod insulator 4 when the smallest diameter rod 1 is pulled out and extending as shown in FIG. 2. Sometimes rain water, etc. further leaks into the drive mechanism which moves the rod antenna up and down (not shown in the drawings). As a result, many different problems can arise, i.e. rust can form over the component members of the drive mechanism or in cold areas, ice can form thus making it impossible to extend or retract the antenna.

SUMMARY OF THE INVENTION

Accordingly, the general object of the present invention is to provide an extensible rod antenna system for vehicles with a drainage outlet through which rain water, etc. can be discharged outside of the antenna storing housing when water leaks into the rod storing housing through the space between the top portion attached to the end of the smallest diameter rod and the rod insulator that is fitted into the inner circumferential wall of the upper portion fitting member, or through the space between the smallest diameter rod and the rod insulator.

The above object of this is invention is accomplished by a unique structure of an extensible rod antenna system for vehicles including an extensible rod antenna element formed of conductive rods which are inserted into a fitting hole on the vehicle body and held by an upper fitting member and by a cylindrical lower fitting member, a drainage port formed on the side wall of the cylindrical lower fitting member, and a drainage pipe connected to an outlet which allows the drainage pipe to discharge outside of the vehicle.

DETAILED DESCRIPTION OF THE INVENTION

Figure 3:
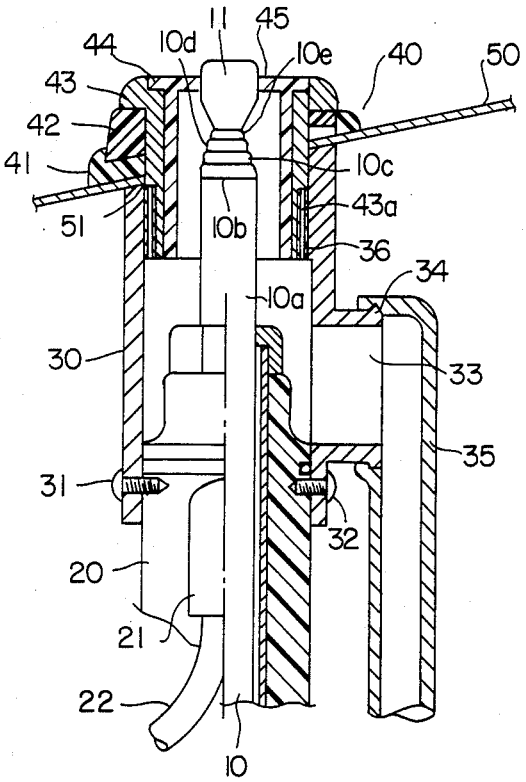
FIG. 3 is a fragmentary sectional view showing the structure of the first embodiment of the present invention.

FIG. 3 is a fragmentary sectional view showing the first embodiment of the present invention. In the Figure, the numeral 10 is an extensible rod antenna element having a plurality (five in this embodiment) of conductive rods 10*a*, 10*b*, 10*c*, 10*d* and 10*e* with respectively different diameters.

These rods 10*a* through 10*e* are connected so as to be freely slidable. At the end of the smallest rod 10*e*, a top piece 11 is disposed. The foregoing extensible rod antenna element 10 is stored in a housing 20 formed of, for example, aluminum pipe. A feeder 22 is connected by way of a feeder connector 21 to the housing 20. The housing 20 is fixed by screws 31 and 32 to a cylindrical lower fitting member 30. This fitting member 30 is formed by die casting and composed of a ground base for ground connection of the antenna element.

A drainage outlet 33 is formed on the side wall of the cylindrical lower fitting member 30. The outer circumference of the open end of the drainage outlet 33 has a drainage pipe engaging portion 34. A drainage pipe 35 is attached to this engaging portion 34 so as to be anchored thereto. The other end of the drainage pipe 35 leads outside of the vehicle.

Along the inner circumferential surface in the upper portion of the cylindrical lower fitting member 30, screw threads 36 are formed. These screw threads 36 screw into and fit the thread grooves 43*a* which are formed along the inner circumference of a nut 43. By screwing the screw threads 36 into the thread grooves 43*a*, the cylindrical lower fitting member 30 and an upper fitting member 40 are clamped to and held in position by a fitting hole 51 located in the wall of the vehicle.

The upper fitting member 40 includes a pad 41, an insulator 42 and the nut 43. Along the inner circumferential wall of the nut 43, a cylindrical rod insulator 44 is provided. Also, this rod insula-tor 44 is provided with a cap portion 45 having a through hole with a diameter nearly equal to that of the top portion 11 so that the cap portion 45 is combined with the rod insulator 44 to form a single body.

Figure 1:
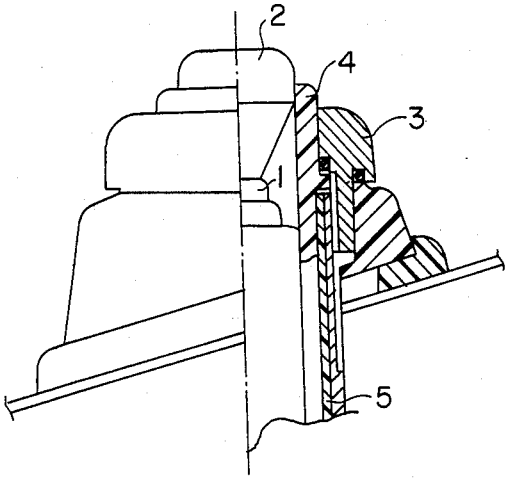
FIG. 1 PRIOR ART
FIGS. 1 and 2 are diagrams of a prior art extensible rod antenna system for vehicles.
Figure 2:
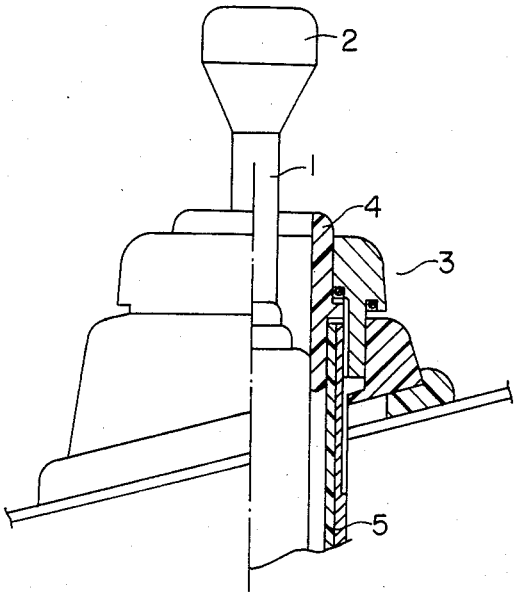
FIG. 2 PRIOR ART
Figure 4:
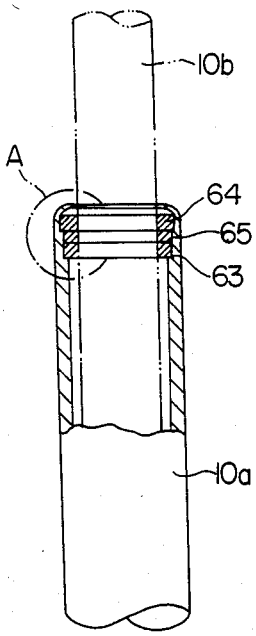
FIG. 4 is a fragmentary sectional view showing the largest diameter rod and the second largest diameter rod (the second stage rod) as a part of an extensible rod antenna element.
Figure 5:
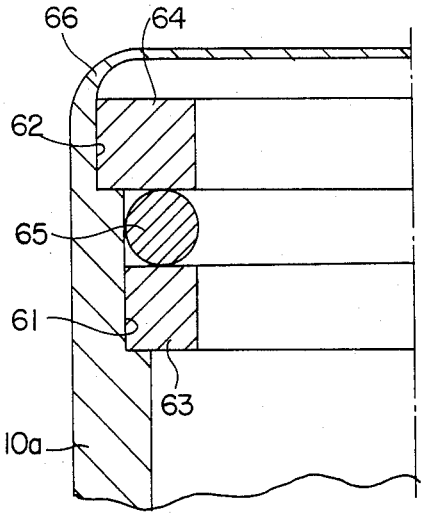
FIG. 5 is an enlarged view of the portion A in FIG. 4.

FIG. 4 is a fragmentary sectional view showing the largest diameter rod 10*a* and the second stage rod 10*b* as a part of the extensible rod antenna element 10. The Figure shows the rods 10*a* and 10*b* extended. FIG. 5 is an enlarged view of the portion A in FIG. 4.

In FIGS. 4 and 5, the numerals 61 and 62 are first and second stepped portions and are of respectively different diameters. The diameter D1 of the first stepped portion 61 is less than the diameter D2 of the second stepped portion 62. First and second collars 63 and 64 are anchored to the first and second stepped portions 61 and 62, respectively. Between the first and second collars 63 and 64, an elastic seal-ing ring 65, made of for examples a conductive rubber O-ring, is fitted. Besides, a part of the upper end face of the largest diameter rod 10*a* is formed into engaging portion 66 to keep the collar from slipping off by caulking work. With the above arrangement provided, leakage of rain water, etc. through the interstage gap between the largest diameter rod 10*a* and the second stage rod 10*b* is prevented. The same waterproofing means are provided for the interstage gaps between the respectively conductive rods 10*a* through 10*e*.

In the above embodiment, when, for example, rain water leaks in through the space between the top portion 11 and the rubber cover (cap portion) 45, the water runs through the drainage pipe 35 through the drainage outlet 33 and outside of the vehicle. Therefore, rain water does not flow into the housing 20 or leak into the interstage gaps between the respective conductive rods into the drive mechanism (not shown) which moves the antenna up and down. Thus, any adverse effects on the operation of the vertical movement of the rod antenna are prevented. Also, interstage leakage of rain water into the element itself does not occur because waterproofing means are provided at each of the interstage spaces of the rod antenna element 10. In addition, in this embodiment it is only required to form the drainage outlet 33 on the side wall of the cylindrical lower fitting member 30. Therefore, the structure of this embodiment is simple, and significant effectiveness can be achieved without incurring a specifically sharp rise in manufacturing cost.

Figure 6:
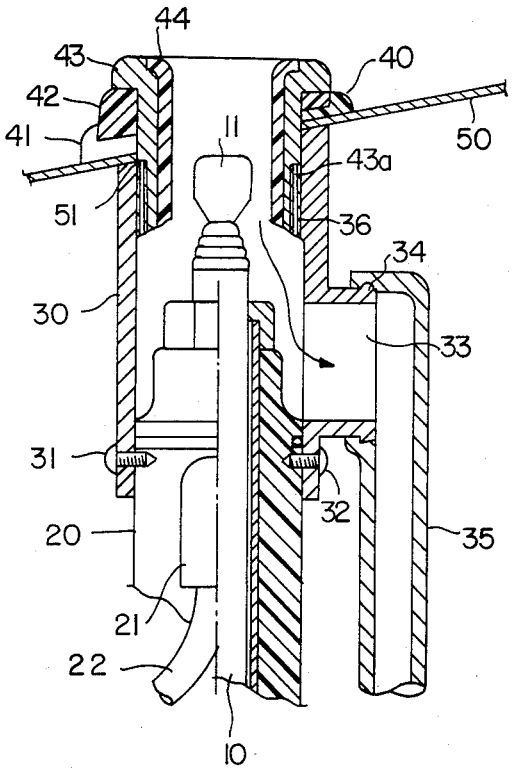
FIG. 6 is a fragmentary sectional view showing the structure of the second embodiment of the present invention.

FIG. 6 is a fragmentary sectional view showing the second embodiment of the invention wherein the extensible rod antenna system is designed such that the top portion 11 can be stored beneath the vehicle wall 50 when it is retracted.

In this second embodiment, a large amount of rain water, etc. can lead through the space between the top portion 11 and the rod insulator 44, but when rain water leaks through, it is discharged outside of the vehicle through the drainage pipe 35. Accordingly, rain water, etc. does not accumulate at the top area of the antenna element and the same effect s obtained in the first embodiment is achieved.

While only preferred embodiments of the invention have been described herein, it should be distinctly understood that the invention is not limited thereto but may be variously embodied within the scope of the following claim.

As has been described in detail, the extensible rod antenna system for this invention includes conductive rods held by a fitting on the vehicle wall by means of the upper fitting member and the cylindrical lower fitting member, the drainage outlet is formed on the lower fitting member, and the drainage pipe connected to the drainage outlet discharges outside of the vehicle. As a result, rain water, etc. leaking into the housing through the space between the top portion disposed at the end of the smallest diameter rod and the rod insulator fitted to the inner circumferential wall of the upper fitting member, and the space between the smallest diameter and the rod insulator, can be discharged out of the vehicle.

I claim:

1. An extensible rod antenna system for vehicles comprising:

an extensible rod antenna element formed of telescopic conductive rods;

a housing for storing said extensible rod antenna element;

an upper fitting member and a cylindrical lower fitting member for mounting the extensible rod antenna element to a fitting hole of a vehicle wall, said cylindrical lower fitting member further having said housing extending therein and coupled thereto;

a drainage outlet formed on a side wall of the cylindrical lower fitting member at a point which is between a top of the housing and said upper fitting member; and a drainage pipe, one end of the pipe being connected to the drainage outlet and the other end opening outside of the vehicle whereby water can be drained away to prevent a leakage of water into gaps between said telescopic conductive rods.

* * * * *